US008009120B2

(12) United States Patent
Thomas et al.

(10) Patent No.: US 8,009,120 B2
(45) Date of Patent: Aug. 30, 2011

(54) REINFORCEMENT FABRICS WITH ELECTRONIC TRANSMISSION CAPABILITIES

(75) Inventors: Gwynned Thomas, Auburn, AL (US); Andrew Sivulka, Auburn, AL (US); Lloyd Stephen Riggs, Auburn, AL (US); David J. Elton, Auburn, AL (US)

(73) Assignee: Auburn University, Auburn, AL (US)

( * ) Notice: Subject to any disclaimer, the term of this patent is extended or adjusted under 35 U.S.C. 154(b) by 1149 days.

(21) Appl. No.: 11/713,953

(22) Filed: Feb. 27, 2007

(65) Prior Publication Data

US 2007/0210966 A1 Sep. 13, 2007

Related U.S. Application Data

(60) Provisional application No. 60/777,330, filed on Feb. 28, 2006.

(51) Int. Cl.
*H01Q 1/36* (2006.01)

(52) U.S. Cl. ..... 343/897; 343/795

(58) Field of Classification Search ..... 343/897, 343/795

See application file for complete search history.

(56) References Cited

U.S. PATENT DOCUMENTS

| | | | | |
|---|---|---|---|---|
| 6,590,540 | B1 * | 7/2003 | Adams et al. | 343/718 |
| 6,677,917 | B2 * | 1/2004 | Van Heerden et al. | 343/897 |
| 6,788,262 | B1 * | 9/2004 | Adams et al. | 343/718 |
| 2003/0142018 | A1 * | 7/2003 | Lange | 343/700 MS |
| 2003/0206775 | A1 | 11/2003 | Markusch et al. | 405/268 |

FOREIGN PATENT DOCUMENTS

JP 63276903 A * 11/1988

OTHER PUBLICATIONS

National Textile Center Annual Report, "Reinforcement fabrics with electronic transmission capabilities", Nov. 2005, pp. 1-8, NTC Project: F05-AE13.

* cited by examiner

*Primary Examiner* — Tan Ho

(74) *Attorney, Agent, or Firm* — Haverstock & Owens LLP

(57) ABSTRACT

Antennas using nonwoven geotextiles with embedded metallic or other wave carrying fibers are described herein. The geotextiles antennas are designed to be an internal, integral part of the nation's infrastructure. Geotextile antennas are flexible and easily conform to natural and manmade surfaces such as exterior building surfaces, for example, roads, roofs and bridges. Geotextile antennas are considerably less vulnerable to damage and probably much less expensive than the current, highly vulnerable and costly cell towers. In particular, geotextiles used in roads are especially well protected by the asphalt pavement above. The fabric-based conformal antenna enhances the usefulness and reliability of the communication infrastructure which is exceedingly vulnerable to vandalism, terrorism and natural disasters.

30 Claims, 7 Drawing Sheets

REINFORCEMENT FABRICS WITH ELECTRONIC TRANSMISSION CAPABILITIES

RELATED APPLICATION(S)

This patent application claims priority under 35 U.S.C. §119(e) of the co-owned U.S. Provisional Patent Application No. 60/777,330, filed Feb. 28, 2006, and entitled "REINFORCEMENT FABRICS WITH ELECTRONIC TRANSMISSION CAPABILITIES" which is hereby incorporated by reference in its entirety.

The U.S. Government has a paid-up license in this invention and the right in limited circumstances to require the patent owner to license others on reasonable terms as provided for by the terms of Contract/Grant No. 02-07400 awarded by the Department of Commerce—National Textile Center.

FIELD OF THE INVENTION

The present invention relates to the field of signal distribution. More specifically, the present invention relates to distributing signals via a fabric with antenna capabilities.

BACKGROUND OF THE INVENTION

As people become more reliant on wireless technology, improvements in providing access to this wireless technology must grow as well. For example, many people complain about the quality of their cellular phone signal. Clearly dropped calls and lack of reception are significant issues for both cellular phone service providers and customers.

Modern wireless and personal communications systems (e.g. cellular phones) operate using: low-power transmitters and small coverage areas or cells, frequency reuse, handoff, central control, and cell splitting to increase call capacity. Each cell requires a tower, antenna and transceiver equipment.

FIG. 1 illustrates a typical cell tower antenna array and raydome (fiberglass cover). The antenna is fragile and is able to be easily rendered inoperable by natural catastrophes, weathering, vandalism and perhaps even deliberate, military attack. Any of these events, from a tornado to a terrorist with a high powered rifle, is able to destroy the antenna and eliminate cellular service within a 25 km radius of the cellular tower. Removal of communications causes serious problems in emergency situations.

It is important to generate mechanically robust antennas to protect (harden) the communication infrastructure against catastrophic events.

SUMMARY OF THE INVENTION

Antennas using nonwoven geotextiles with embedded metallic or other wave carrying fibers are described herein. The geotextiles antennas are designed to be an internal, integral part of the nation's infrastructure. Geotextile antennas are flexible and easily conform to natural and manmade surfaces such as exterior building surfaces, for example, roads, roofs and bridges. Geotextile antennas are considerably less vulnerable to damage and probably much less expensive than the current, highly vulnerable and costly cell towers. In particular, geotextiles used in roads are especially well protected by the asphalt pavement above. The fabric-based conformal antenna enhances the usefulness and reliability of the communication infrastructure which is exceedingly vulnerable to vandalism, terrorism and natural disasters.

In one aspect, a system for transmitting and receiving signals comprises a geotextile and one or more antennas positioned on the geotextile for transmitting and receiving the signals. The system further comprises a power source coupled to the one or more antennas for providing power. The power source is selected from the group consisting of a piezoelectric device, a solar panel and a battery. The one or more antennas are coupled to each other by a signal carrier. The geotextile is selected from the group consisting of nonwoven, knitted and woven fabrics. The one or more antennas are selected from the group consisting of metallic wires, metallic fibers and a conductive polymer. The geotextile and the one or more antennas are flexible. Locations of where the geotextile and the one or more antennas are placed include under roads and sidewalks, within foundations and tunnel walls, on roofs and building walls and around trees. The geotextile includes electrically conductive components that are approximately a resonant length. The geotextile and the one or more antennas include at least one of electromagnetic, radio signal and fiber optic capabilities. The geotextile and the one or more antennas transmit at least one of cellular phone signals, television signals, radio signals and tracking signals. Fibers of the geotextile are selected from polyester, polypropylene and polyethylene. The one or more antennas are embedded within the geotextile. The one or more antennas lie on top of the geotextile. The system further comprises a receiver for receiving the signals from the one or more antennas. The one or more antennas are configured perpendicular to a road. The one or more antennas are selected from the group consisting of patch and dipole antennas. The system further comprises one or more connectors for coupling the one or more antennas to another connector.

In another aspect, a system for transmitting and receiving signals comprises a geotextile, one or more antennas positioned on the geotextile for transmitting and receiving the signals, a power source coupled to the one or more antennas for providing power to the one or more antennas and a receiver for receiving signals from the one or more antennas. The power source is selected from the group consisting of a piezoelectric device, a solar panel and a battery. The one or more antennas are coupled to each other by a signal carrier. The geotextile is selected from the group consisting of nonwoven, knitted and woven fabrics. The one or more antennas are selected from the group consisting of metallic wires, metallic fibers and a conductive polymer. The geotextile and the one or more antennas are flexible. Locations of where the geotextile and the one or more antennas are placed include under roads and sidewalks, within foundations and tunnel walls, on roofs and building walls and around trees. The geotextile includes electrically conductive components that are approximately a resonant length. The geotextile and the one or more antennas include at least one of electromagnetic, radio signal and fiber optic capabilities. The geotextile and the one or more antennas serve to transmit at least one of cellular phone signals, television signals, radio signals and tracking signals. Fibers of the geotextile are selected from polyester, polypropylene and polyethylene. The one or more antennas are embedded within the geotextile. The one or more antennas lie on top of the geotextile. The one or more antennas are configured perpendicular to a road. The one or more antennas are selected from the group consisting of patch and dipole antennas. The system further comprises one or more connectors for coupling the one or more antennas to another connector.

In another aspect, a method of manufacturing a geotextile antenna comprises coupling one or more antennas to a geotextile. The antennas are coupled to each other to form a set of antennas. The method further comprises rolling out the geotextile with the set of antennas coupled to the geotextile. Coupling includes warp knitting. The method further comprises cutting the geotextile with the set of antennas into sections. The method further comprises coupling connectors to each end of the set of antennas.

In yet another aspect, a method of installing a geotextile antenna system comprises depositing a geotextile with a set of antennas and securing the geotextile with the set of antennas in place. The method further comprises installing a power supply coupled to the geotextile with the set of antennas. The method further comprises installing a receiver to receive signals from the geotextile with the set of antennas. Depositing is selected from the group consisting of rolling out, laying out and hanging. Securing is selected from the group consisting of pouring asphalt and utilizing fasteners.

In another aspect, a method of installing a geotextile antenna system comprises depositing a geotextile and depositing one or more antennas on the geotextile. The method further comprises installing a power supply coupled to the one or more antennas. The method further comprises installing a receiver to receive signals from the one or more antennas. Depositing a geotextile is selected from the group consisting of rolling out, laying out and hanging. The method further comprises securing the geotextile and the one or more antennas in place. Securing is selected from the group consisting of pouring asphalt and utilizing fasteners.

In another aspect, a network of geotextile antennas comprises a plurality of geotextile antennas wherein each of the geotextile antennas comprises a geotextile, one or more antennas positioned on the geotextile for transmitting and receiving the signals and one or more connectors for coupling each of the geotextile antennas to a next geotextile antenna. The network further comprises a power source coupled to the one or more antennas for providing power. The power source is selected from the group consisting of a piezoelectric device, a solar panel and a battery. The one or more antennas are coupled to each other by a signal carrier. The geotextile is selected from the group consisting of nonwoven, knitted and woven fabrics. The one or more antennas are selected from the group consisting of metallic wires, metallic fibers and a conductive polymer. The geotextile and the one or more antennas are flexible. Locations of where the geotextile and the one or more antennas are placed include under roads and sidewalks, within foundations and tunnel walls, on roofs and building walls and around trees. The geotextile includes electrically conductive components that are approximately a resonant length. The geotextile and the one or more antennas include at least one of electromagnetic, radio signal and fiber optic capabilities. The geotextile and the one or more antennas transmit at least one of cellular phone signals, television signals, radio signals and tracking signals. Fibers of the geotextile are selected from polyester, polypropylene and polyethylene. The one or more antennas are embedded within the geotextile. The one or more antennas lie on top of the geotextile. The network further comprises a receiver for receiving the signals from the one or more antennas. The one or more antennas are configured perpendicular to a road. The one or more antennas are selected from the group consisting of patch and dipole antennas.

In yet another aspect, a system for delivering a service comprising a geotextile comprising a conductive material wherein the geotextile is able to carry the service from a first location to a second location. The service is selected from the group consisting of telephone, electricity, cable and Internet. The conductive material is selected from the group consisting of a metal and a conductive polymer. The geotextile forms a grid. The geotextile is placed under a surface.

DETAILED DESCRIPTION OF THE PREFERRED EMBODIMENT

The present invention provides antennas that are much less susceptible to destruction by embedding them in the infrastructure of roads, foundations, tunnel walls and other locations. Geotextile antennas are constructed of nonwoven geotextile with embedded metallic or other wave carrying wires/fibers. The geotextile antennas are also flexible, enabling them to easily conform to natural and manmade surfaces such as trees and exterior building surfaces (e.g. roofs, bridges). In a specific application, geotextile antennas used in roadways are protected by the asphalt pavement. Since geotextiles are already used in many roadways, the new geotextile antenna serves dual purposes, road reinforcement and cell phone/wireless antennas.

Modern cellular systems in the United States operate at a frequency of approximately 2 GHz ($2\times10^9$ Hz). Resonant length antennas are most efficient. These lengths are approximately half the wavelength they are expected to receive. Based on the above half-wavelength criterion, individual cellular antennas should be approximately 7.5 cm long. To improve the "gain," groups of resonant length antennas are used. For example, the cell tower antenna in FIG. 1 uses six antenna elements to improve gain over what would be achieved with a single patch.

Figure 1:
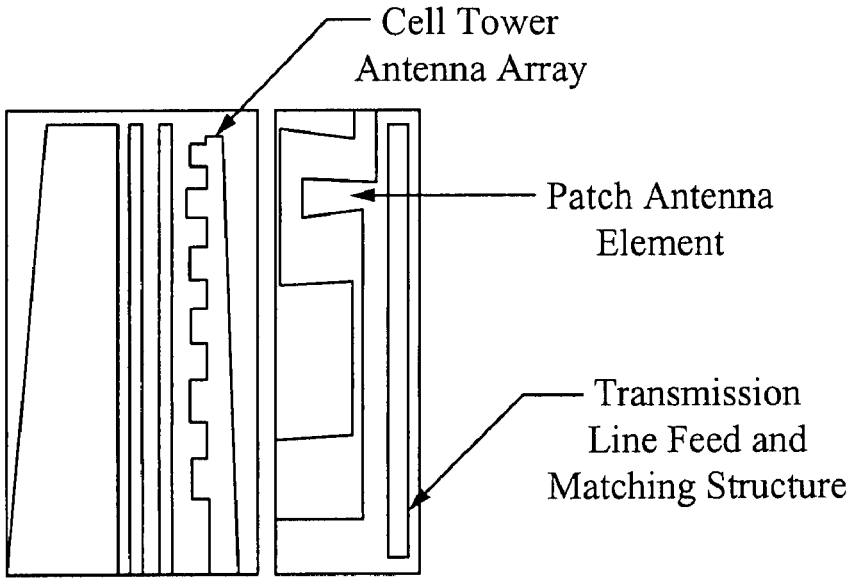
FIG. 1 illustrates a cellular phone antenna.

To ensure resonant operation, the antenna length must be reduced by the square root of the dielectric constant of the material on which the antenna is placed (e.g. the patch antenna elements in FIG. 1). High-dielectric constant materials, including some geotextile materials, are able to be used to reduce the overall physical size of the antenna or antenna array. To be effective antennas, the geotextiles have electrically conductive parts that are close to the resonant length. A novel manufacturing technique achieves this, as will be described below.

The fundamental antenna design principles above are able to be satisfied using metallic laden geotextile materials. Metallic threads (or thread bundles) of resonant length and spacing between bundle centers must also be on the order of a wavelength or less to avoid grating lobes (radiation in undesirable directions). Incorporation of electromagnetic capable, radio signal carrier and/or fiber optic technology into geotextile structures allows the structures to replace antennas, transmission wires and fiber optic networks. Electrically conductive polymers are also usable. This is also able to be applied as part of a resin matrix slurry or transmissible matrix media for composite structures. Transmission and receiver materials are able to be incorporated in woven, knitted and/or nonwoven fabric structures.

The geotextile antenna is then able to serve as a continuous antenna and transmission bed for cell phones, television signals, radio signals and tracking media. Further uses include providing the basis for traffic flow control on roads, interstate highways, railroads and airport taxiways.

Various conventional and unconventional antenna materials are able to be used, provided they meet the criteria of transmission, reception, strength, compatibility with existing geotextile materials and performance in structural textile fabrics.

Typically asphalt on major roadways ranges from 5 to 6.5 cm thick. Any antenna planted below the roadway has to be capable of receiving and transmitting signals of the appropriate wavelengths through this thickness of asphalt. In applications that are not beneath asphalt, such as on trees or roofs, the antennas do not require as much receiving/transmitting power. Furthermore, roadway overlays are usually only 2.5 cm thick, so a less strong antenna is required. Conversely, applications where the antenna is below even thicker material, such as in a foundation of a house, even stronger antennas are required.

To provide power to the geotextile antennas, self actuated power sources such as piezoelectric, pressure activated and solar conversion sources are possible, in addition to other power sources.

The structural fiber of the geotextiles is durable against high temperature exposure since, for example, asphalt is applied at a temperature of about 140° C. Several commonly used fibers in geotextiles include polyester and polypropylene. High density polyethylene is another possible material for use other than with asphalt since its melting point is lower than 140° C.

Hence, antennas are able to be built out of roadbed material and are able to be buried under asphalt and still transmit powerful signals. Preferably the antennas are dipole antennas. Dipole antennas are able to be used with woven fabric where the antennas are directly integrated into the geotextile. As will be apparent to those skilled in the art, other types of antennas are also able to be used as described herein.

Figure 2:
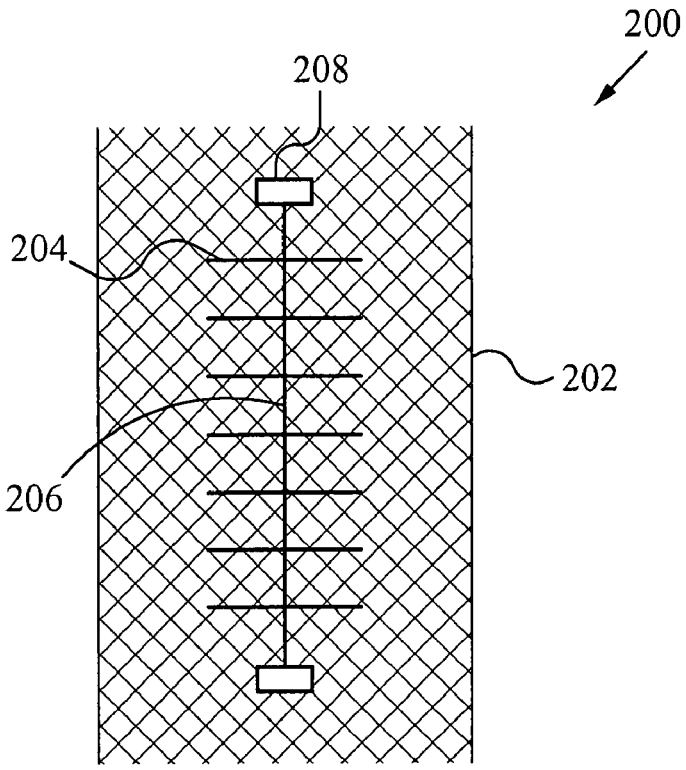
FIG. 2 illustrates a graphical representation of a geotextile antenna.

FIG. 2 illustrates a graphical representation of a geotextile antenna 200. The geotextile antenna 200 includes a geotextile 202, one or more antennas 204, a signal carrier 206 and one or more connectors 208. The geotextile 202 is a woven or unwoven fabric which meets specified requirements to allow proper signal conduction while also maintaining durability. The one or more antennas 204 are preferably dipole antennas which are spaced appropriately to maximize the signal receiving and transmitting capabilities while not wasting materials and avoiding interference issues. The one or more antennas 204 are each of a length equal to a multiple of the broadcast frequency. Preferably, the antennas are dipole antennas. Alternatively, the antennas are other types of antennas such as patch antennas. The signal carrier 206 couples each of the one or more antennas 204 together serially. At each end of the signal carrier 206 is the connector 208, so that multiple geotextile antennas 200 are able to be coupled together. Preferably, the antennas 204 run perpendicular to the road; however, alternative configurations are possible. To provide redundancy in case the signal carrier 206 is severed, a second signal carrier is able to be positioned along the line of antennas. Other redundancy configurations are also possible, such as a web of signal carriers.

Figure 3A:
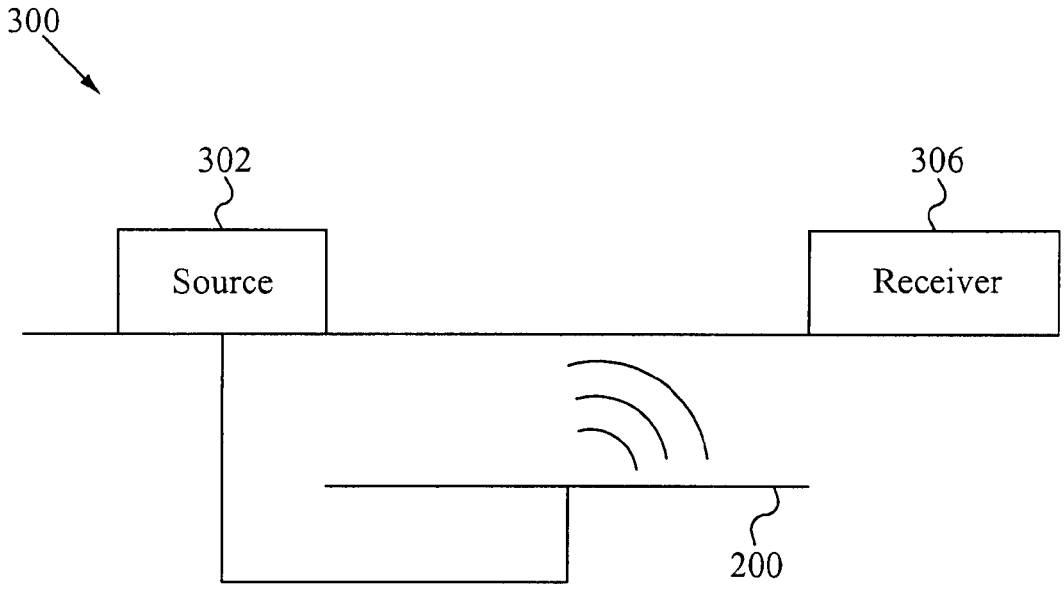
FIG. 3A illustrates a graphical representation of a geotextile antenna system.

FIG. 3A illustrates a graphical representation of a geotextile antenna system 300. A power source 302 provides power necessary to operate the geotextile antenna 200. The power source 302 couples to the geotextile antenna 200 depending on the manufacturing of the geotextile antenna 200. For example, the power source 302 is able to couple to the geotextile 202 (FIG. 2), or the power source 302 is able to couple through another mechanism to the geotextile antenna 200. The power source 302 is able to be any power source such as a battery or a solar cell. The geotextile antenna 200 transmits a signal to a receiver 306. Depending on the capabilities of the receiver 306, the receiver 306 either transmits the signal to another receiver such as to a base station or a satellite, or otherwise, processes the signal. Preferably, the receiver 306 is at a distance from the antennas so that a minimal number of receivers are required, but near enough to ensure the signal will be received.

Figure 3B:
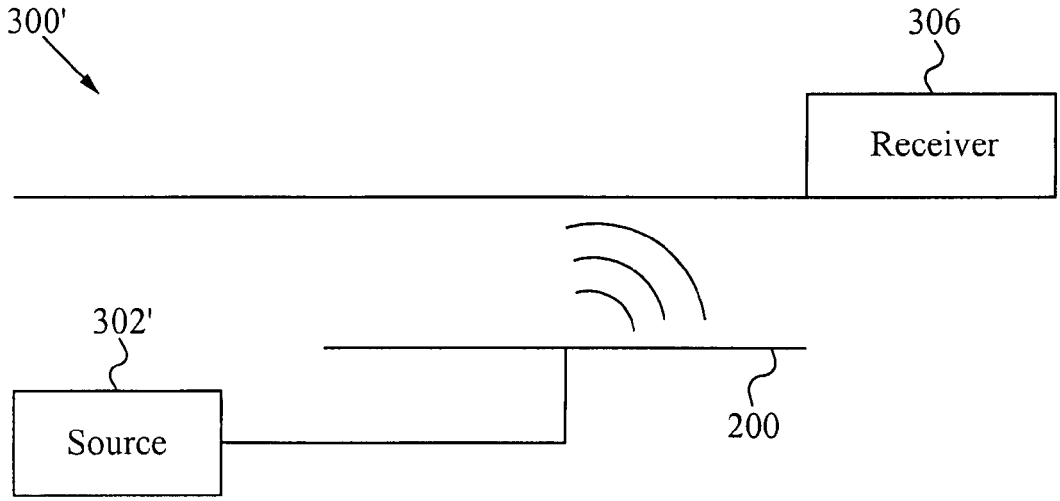
FIG. 3B illustrates a graphical representation of an alternative embodiment of a geotextile antenna system.

FIG. 3B illustrates a graphical representation of an alternative embodiment of a geotextile antenna system 300'. The geotextile antenna system 300' utilizes an underground power source 302' such as a piezoelectric device wherein the weight of a vehicle generates a pulse of power. The geotextile antenna 200 transmits signals to the receiver 306 as described above.

Figure 4:
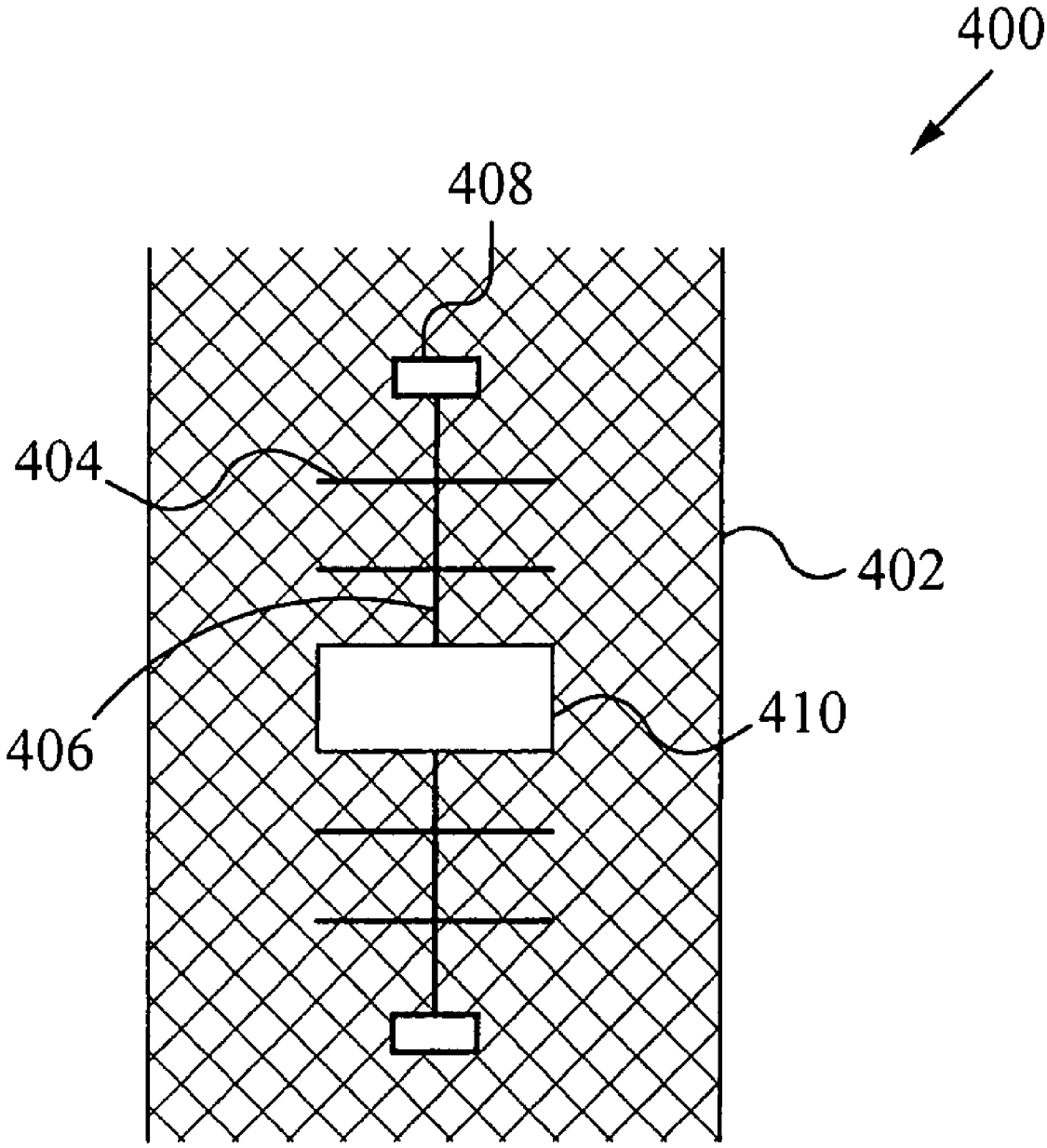
FIG. 4 illustrates a graphical representation of an alternative embodiment of a geotextile antenna.

FIG. 4 illustrates a graphical representation of an alternative embodiment of a geotextile antenna 400. The geotextile antenna 400 includes a geotextile 402, one or more antennas 404, a signal carrier 406, one or more connectors 408 and a sensing/computing component 410. The geotextile 402 is a woven or unwoven fabric which meets specified requirements to allow proper signal conduction while also maintaining durability. The one or more antennas 404 are preferably dipole antennas which are spaced appropriately to maximize the signal receiving and transmitting capabilities while not wasting materials and also avoiding interference issues. The one or more antennas 404 are each of a length equal to a multiple of the broadcast frequency. Preferably, the antennas are dipole antennas. In other embodiments, the antennas are other types of antennas such as patch antennas. The signal carrier 406 couples each of the one or more antennas 404 together serially. At each end of the signal carriers 406 is the connector 408, so that multiple geotextile antennas 400 are able to be coupled together. Preferably, the antennas 404 run perpendicular to the road; however, alternative configurations are possible. The sensing/computing component 410 receives signals and determines actions to communicate based on the received signals. For example, when the geotextile antenna 400 is used to provide wireless access to the Internet, data signals are received from users' computers within their vehicles. The sensing/computing component 410 receives and then transmits this data to a receiver such as a base station which is linked to the Internet.

Figure 5:
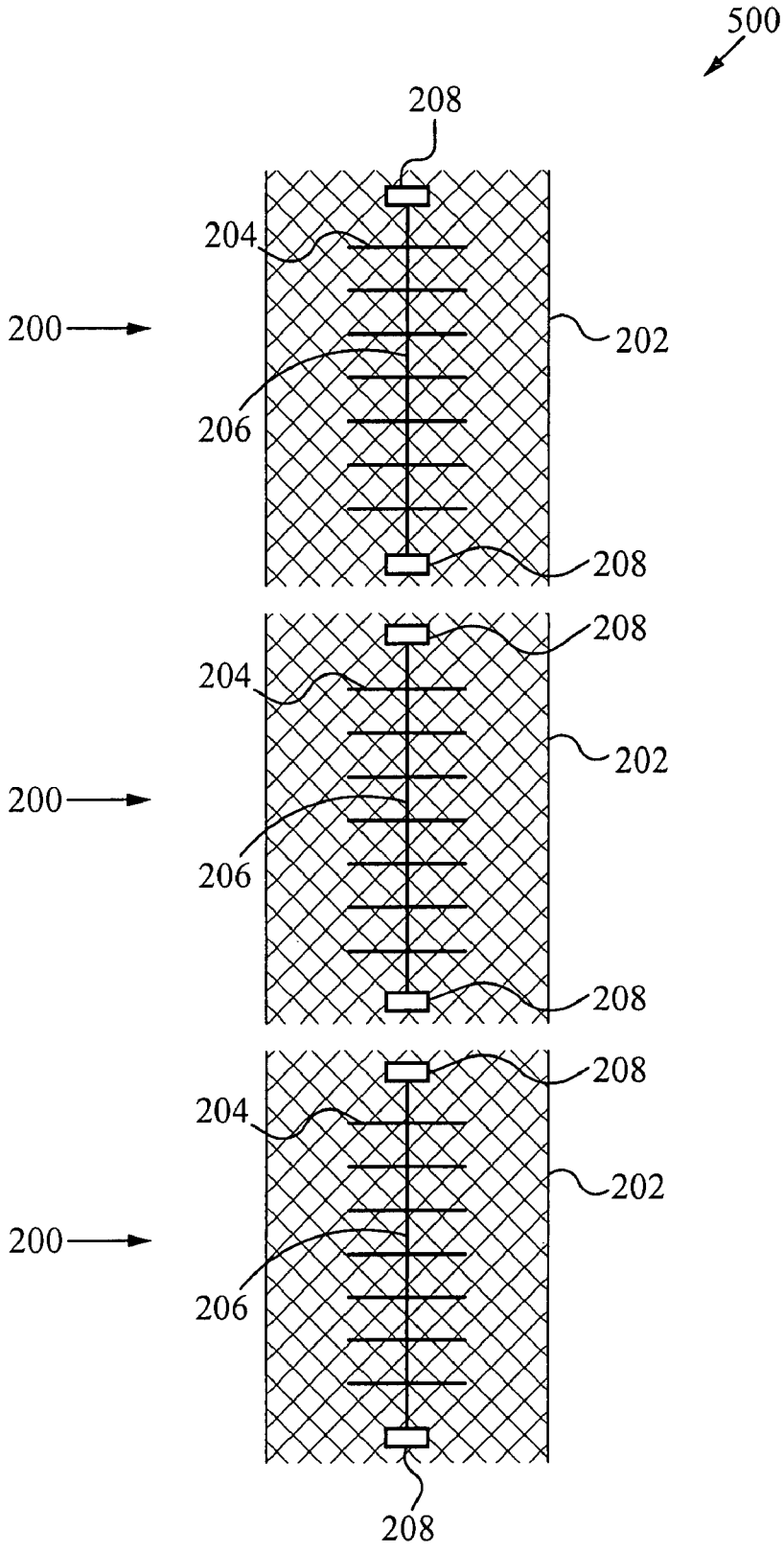
FIG. 5 illustrates a graphical representation of a network of geotextile antennas.

FIG. 5 illustrates a graphical representation of a network 500 of geotextile antennas 200. Each of the geotextile antennas 200 is described above where antennas are coupled together with a signal carrier on/within a geotextile. At the end of each signal carrier is a connector for coupling the geotextile antennas 200 together. By combining the geotextile antennas 200 to form a network 500 of geotextile antennas 200, an entire roadway is able to become one huge set of antennas and thus the entire infrastructure is able to be coupled at least partially to form an enormous network of antennas. Although the network 500 as shown in FIG. 5 only includes geotextile antennas 200, any type of geotextile antennas are able to be included in the network 500, for example the geotextile antennas 400 with the sensor/computing component 410. By generating a network 500 of geotextile antennas 200, users will no longer suffer dropped calls or Internet dead zones. It is possible for a number of the geotextile antennas 200 to share a power source and/or a receiver. For example, a power source is strong enough to support 50 of the geotextile antennas 200, and a receiver is capable of receiving signals from 20 of the geotextile antennas 200. The number of geotextile antennas 200 per power source and receiver are dependent on the specific power sources, receivers and geotextile antennas used.

Figure 6:
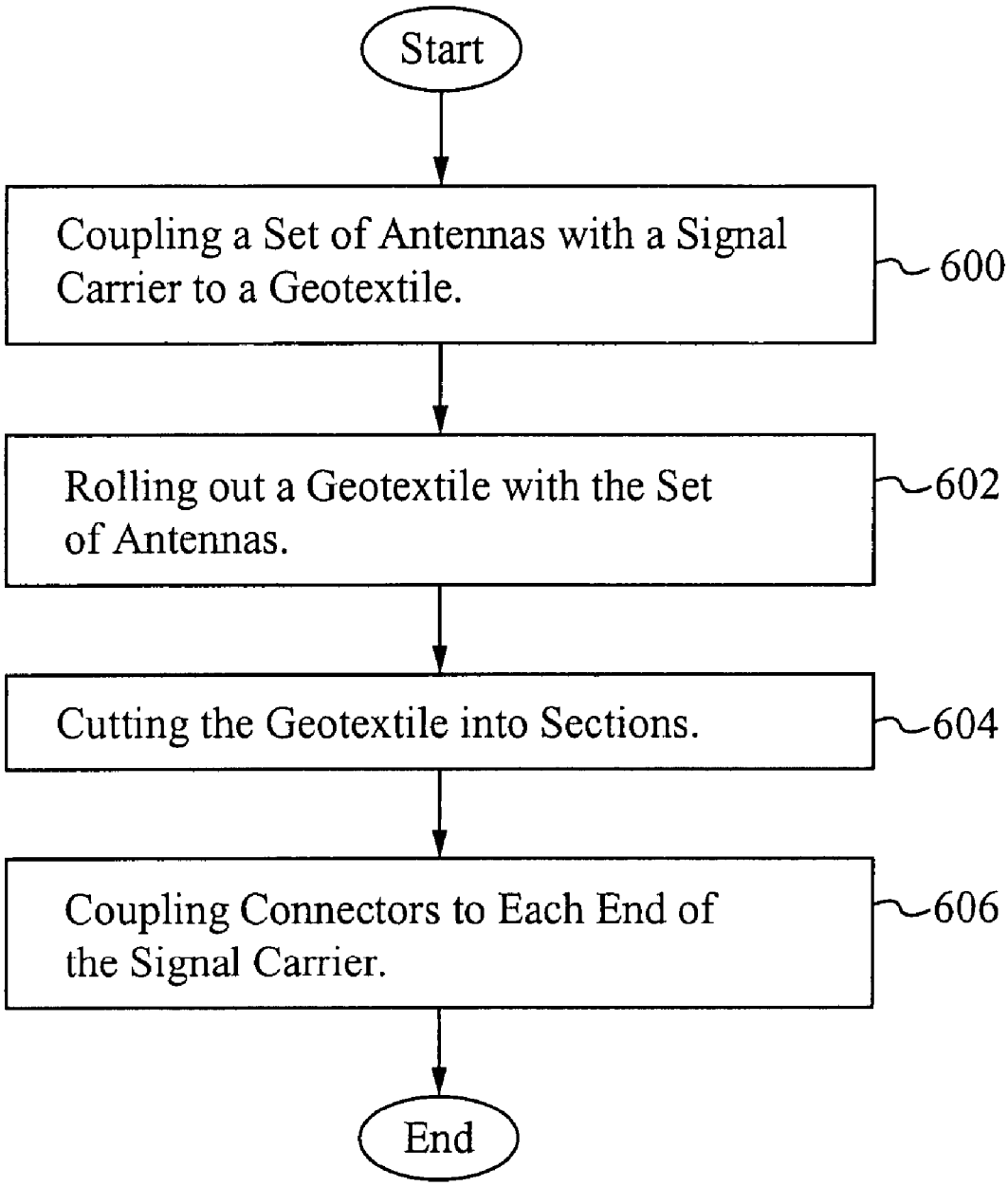
FIG. 6 illustrates a flowchart of a process of manufacturing a geotextile antenna.

FIG. 6 illustrates a flowchart of a process of manufacturing a geotextile antenna. In the step 600, a set of antennas are coupled to a geotextile, wherein the set of antennas is one or more antennas. The set of antennas are preferably coupled by a signal carrier. In the step 602, the geotextile and the set of antennas are rolled out. Specifically, in an embodiment, warp knitting machinery is able to be used to directly integrate the antennas into the geotextile. The end result of the manufacturing process is a geotextile with the set of antennas in a long, relatively flat configuration similar to other textiles. Preferably, the set of antennas are coupled to each other by a signal carrier. In the step 604, the geotextile with the set of antennas is cut into sections as desired. Alternatively, the geotextile and antennas are not cut into sections. In the step 606, connectors are attached to the ends of the signal carriers so that each section of geotextile with antennas is able to couple to another section of geotextile with antennas.

Figure 7:
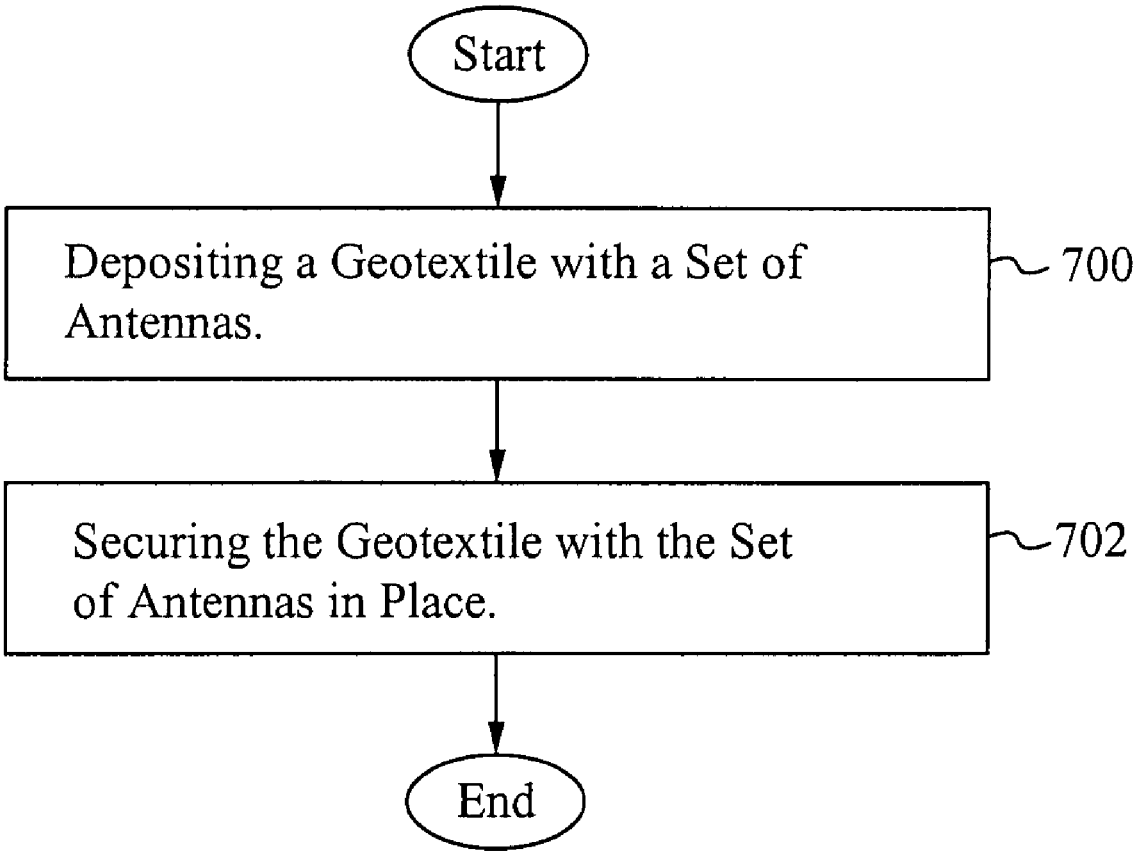
FIG. 7 illustrates a flowchart of a process of installing a geotextile antenna system.

FIG. 7 illustrates a flowchart of a process of installing a geotextile antenna system. In the step 700, a geotextile with a set of antennas is deposited. The geotextile with antennas is able to be deposited anywhere such as on the ground where a road is to be laid over it, on a roof or on a tree. Furthermore, depositing the geotextile with antennas includes rolling out, laying out, hanging or any other method of placing the geotextile with antennas in a desired location. In the step 702, the geotextile with antennas is secured in place. The geotextile with antennas is secured in place utilizing any appropriate mechanism such as pouring asphalt on top or utilizing fasteners to couple the geotextile with antennas to another object such as a tree or a roof. As described briefly above, the geotextile with antennas is deposited where signals are able to be transmitted and received. Therefore, when being deposited beneath a roadway, the geotextile with antennas is roughly 2"-6" below the surface where the antennas have the requisite signal sensitivity and strength. In additional steps, the power supply and receiver are also installed within appropriate distances as dictated by the capabilities of the antennas.

Figure 8:
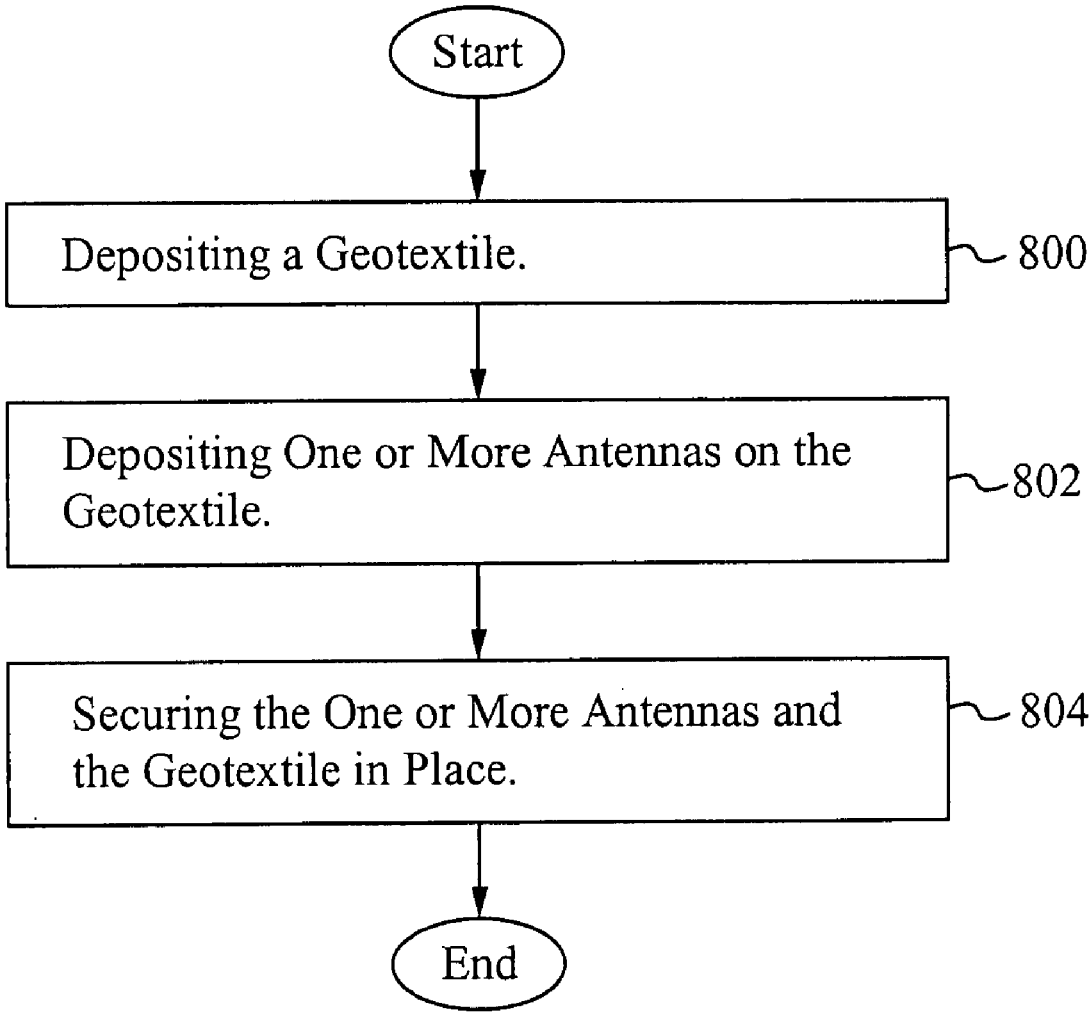
FIG. 8 illustrates a flowchart of a process of installing a geotextile antenna system wherein the geotextile and the antennas are not coupled together at manufacturing.

FIG. 8 illustrates a flowchart of a process of installing a geotextile antenna system wherein the geotextile and the antennas are not coupled together at manufacturing. In the step 800, a geotextile is deposited. The geotextile is able to be deposited anywhere such as on the ground where a road is to be laid over it, on a roof, or on a tree. Furthermore, depositing the geotextile includes rolling out, laying out, hanging or any other method of placing the geotextile in a desired location. In the step 802, one or more antennas are deposited on the geotextile. The one or more antennas are deposited appropriately so that they are able to provide adequate signal reception and transmission. The one or more antennas and geotextile are secured in place utilizing an appropriate mechanism such as pouring asphalt on top or fastening the geotextile to an object and utilizing fasteners to couple the one or more antennas to the geotextile. As described above, the power supply and receiver are also installed within appropriate distances as dictated by the capabilities of the antennas.

An example of installing the geotextile and the one or more antennas is described. To install the geotextile and the one or more antennas under a roadway, the ground beneath the road is prepared, for example the ground is flattened. Then the geotextile is laid out or rolled out onto the flattened ground. The one or more antennas are then deposited on the geotextile. For multiple antennas, they are coupled together utilizing connectors. The antennas are coupled to a power source which is either above ground such as a solar panel or below ground such as a piezoelectric sensor. Afterwards, the roadway (asphalt) is deposited over the antennas and the geotextile therefore securing them in place. Receivers are able to be positioned before or after the geotextile and antennas are secured in place.

To utilize the present invention, one or more antennas are coupled to or utilized with a geotextile, and the antennas and geotextile are placed in a desired location such as beneath a road, on a roof or around a tree. Once in the desired location, the antennas receive and transmit signals, so that users are able to receive and transmit signals from a plethora of devices. Depending on how the geotextile and antennas are configured a user is able to utilize the geotextile antenna system to use his/her cellular phone, the Internet and/or television amongst other items. Generally, the geotextile antenna system allows communication between devices that otherwise is difficult, inefficient or insufficient such as communicating via cellular phone in a tunnel. For many applications, the user is not required to perform additional actions to utilize the present invention. For example, when a user is communicating on his/her cellular phone without the present invention he/she simply calls and talks. With the present invention, the same activities occur, except the reception is better. Similarly, to utilize the Internet via a wireless connection, instead of searching around for a hotspot, with the roads Internet-capable, everywhere there is a road is able to be a hotspot. With specialized functions such as vehicle speed monitoring, vehicle tracking, traffic re-routing and accident avoidance, additional steps may be required to implement and utilize the present invention. Again though, the present invention generally is able to receive and transmit wireless signals, so any implementation still utilizes this general concept.

In operation, the present invention enables wireless devices to receive and transmit signals as long as the devices are within range of a geotextile antenna. The present invention is embedded within/under roads, attached to roofs, wrapped around trees and placed in other locations to permit reception and transmission of signals. By having multiple antennas in these locations, a signal which is too faint to be received by a cellular phone tower is received by the one or more antennas and then is transmitted to either a base station, satellite or other system for transferring the signal to its desired destination. In operation, the present invention enables many new applications where signals are transmitted and received.

In addition to being used for cellular phones, the present invention is able to be used for any other wireless signal such as television, Internet and more. For example, a vehicle equipped with wireless cable is able to receive ESPN on an on-board television monitor. Additionally, Internet access is possible. Other systems are possible as well, such as one that tracks the vehicle and other vehicles around to take emergency measures to avoid collisions or reroute drivers when there is traffic ahead. Police are able to use the present invention to monitor speeds of vehicles since the speed of the vehicle is able to be recorded as each vehicle passes an antenna. Speeding tickets are able to be automatically generated. With a robust system, vehicles are able to be automatically driven whereby information such as navigational information is received from the geotextile antennas. Vehicles are able to be better tracked utilizing the present invention, for example, if a vehicle is stolen. Vehicles are able to also provide indications such as an alarm if a driver veers off the road due to fatigue. To prevent drunk driving, the present invention is able to incorporate an algorithm to monitor driving patterns, and if a pattern representative of a drunk driver is determined, local authorities are able to be informed. By incorporating additional circuitry in vehicles, not only are local authorities contacted, but the vehicle automatically pulls to the side of the road and turns off if the drunk driving pattern is established. Additionally, non-vehicular uses are applicable as well. Many cities and buildings are becoming Wi-Fi hotspots, however there are always small gaps where the signals are not strong enough. With the present invention, inside and outside, there is potential to provide adequate signals for everyone. Furthermore, the present invention is able to be used to assist pilots in landing by providing airplane position information with respect to the runway.

Beyond the use of an antenna supplying cellular phone signals, the present invention is able to be used to deliver services to homes and businesses such as telephone, cable, Internet and electrical power through a grid under roads.

The present invention has been described in terms of specific embodiments incorporating details to facilitate the understanding of principles of construction and operation of the invention. Such reference herein to specific embodiments and details thereof is not intended to limit the scope of the claims appended hereto. It will be readily apparent to one skilled in the art that other various modifications may be made in the embodiment chosen for illustration without departing from the spirit and scope of the invention as defined by the claims.

What is claimed is:

1. A system for transmitting and receiving signals comprising:

a. a geotextile;

b. one or more antennas positioned on the geotextile for transmitting and receiving the signals;

c. a power source coupled to the one or more antennas for providing power to the one or more antennas;

d. a receiver for receiving signals from the one or more antennas; and e. one or more connectors for coupling the one or more antennas to another connector;

wherein locations of where the geotextile and the one or more antennas are placed include under roads and sidewalks, within foundations and tunnel walls, on roofs and building walls and around trees.

2. The system as claimed in claim 1 wherein the power source is selected from the group consisting of a piezoelectric device, a solar panel and a battery.

3. The system as claimed in claim 1 wherein the one or more antennas are coupled to each other by a signal carrier.

4. The system as claimed in claim 1 wherein the geotextile is selected from the group consisting of nonwoven, knitted and woven fabrics.

5. The system as claimed in claim 1 wherein the one or more antennas are selected from the group consisting of metallic wires, metallic fibers and a conductive polymer.

6. The system as claimed in claim 1 wherein the geotextile and the one or more antennas are flexible.

7. The system as claimed in claim 1 wherein the geotextile includes electrically conductive components that are approximately a resonant length.

8. The system as claimed in claim 1 wherein the geotextile and the one or more antennas include at least one of electromagnetic, radio signal and fiber optic capabilities.

9. The system as claimed in claim 1 wherein the geotextile and the one or more antennas serve to transmit at least one of cellular phone signals, television signals, radio signals and tracking signals.

10. The system as claimed in claim 1 wherein fibers of the geotextile are selected from polyester, polypropylene and polyethylene.

11. The system as claimed in claim 1 wherein the one or more antennas are embedded within the geotextile.

12. The system as claimed in claim 1 wherein the one or more antennas lie on top of the geotextile.

13. The system as claimed in claim 1 wherein the one or more antennas are configured perpendicular to a road.

14. The system as claimed in claim 1 wherein the one or more antennas are selected from the group consisting of patch and dipole antennas.

15. A network of geotextile antennas comprising a plurality of geotextile antennas wherein each of the geotextile antennas comprises:

a. a geotextile;

b. one or more antennas positioned on the geotextile for transmitting and receiving the signals; and c. one or more connectors for coupling each of the geotextile antennas to a next geotextile antenna;

wherein locations of where the geotextile and the one or more antennas are placed include under roads and sidewalks, within foundations and tunnel walls, on roofs and building walls and around trees.

16. The network as claimed in claim 15 further comprising a power source coupled to the one or more antennas for providing power.

17. The network as claimed in claim 16 wherein the power source is selected from the group consisting of a piezoelectric device, a solar panel and a battery.

18. The network as claimed in claim 15 wherein the one or more antennas are coupled to each other by a signal carrier.

19. The network as claimed in claim 15 wherein the geotextile is selected from the group consisting of nonwoven, knitted and woven fabrics.

20. The network as claimed in claim 15 wherein the one or more antennas are selected from the group consisting of metallic wires, metallic fibers and a conductive polymer.

21. The network as claimed in claim 15 wherein the geotextile and the one or more antennas are flexible.

22. The network as claimed in claim 15 wherein the geotextile includes electrically conductive components that are approximately a resonant length.

23. The network as claimed in claim 15 wherein the geotextile and the one or more antennas include at least one of electromagnetic, radio signal and fiber optic capabilities.

24. The network as claimed in claim 15 wherein the geotextile and the one or more antennas transmit at least one of cellular phone signals, television signals, radio signals and tracking signals.

25. The network as claimed in claim 15 wherein fibers of the geotextile are selected from polyester, polypropylene and polyethylene.

26. The network as claimed in claim 15 wherein the one or more antennas are embedded within the geotextile.

27. The network as claimed in claim 15 wherein the one or more antennas lie on top of the geotextile.

28. The network as claimed in claim 15 further comprising a receiver for receiving the signals from the one or more antennas.

29. The network as claimed in claim 15 wherein the one or more antennas are configured perpendicular to a road.

30. The network as claimed in claim 15 wherein the one or more antennas are selected from the group consisting of patch and dipole antennas.

* * * * *